United States Patent [19]

Kurita et al.

[11] Patent Number: 4,851,508

[45] Date of Patent: Jul. 25, 1989

[54] POLYESTER FIBERS HAVING HIGH STRENGTH AND HIGH MODULUS AND PROCESS FOR PRODUCING THE SAME

[75] Inventors: Kazuo Kurita; Masahiro Hayashi; Toshihiko Ohta; Hideaki Ishihara; Fujio Okada; Wataru Yoshikawa; Akira Chiba; Susumu Tate, all of Ohtsu, Japan

[73] Assignee: Toyo Boseki Kabushiki Kaisha, Osaka, Japan

[21] Appl. No.: 68,213

[22] Filed: Jun. 30, 1987

[30] Foreign Application Priority Data

| | | | |
|---|---|---|---|
| Jul. 2, 1986 | [JP] | Japan | 61-155249 |
| Oct. 15, 1986 | [JP] | Japan | 61-246165 |
| Feb. 4, 1987 | [JP] | Japan | 62-23976 |
| Feb. 4, 1987 | [JP] | Japan | 62-23977 |

[51] Int. Cl.[4] ..... C08G 63/02

[52] U.S. Cl. ..... 528/272; 528/289; 528/308.1; 528/308.2; 264/176.1; 264/210.7; 264/210.8

[58] Field of Search ..... 264/176.1, 210.7, 210.8; 528/272, 308.1, 308.2, 289

[56] References Cited

U.S. PATENT DOCUMENTS 4,414,169 11/1983 McClary ..... 264/210.8
4,433,117 2/1984 Takayanagi et al. ..... 528/289

*Primary Examiner*—John Kight
*Assistant Examiner*—Samuel A. Acquah
*Attorney, Agent, or Firm*—Wegner & Bretschneider

[57] ABSTRACT

Polyester fibers having both a high strength and a high modulus prepared from ethylene terephthalate polyester, and having an intrinsic viscosity of not less than 1.0 and an initial tensile modulus is not less than 130 g/d, said intrinsic viscosity being determined in a mixed solvent of p-chlorophenol and tetrachloro ethane (3:1) at 30° C. Processes for producing the fibers are also disclosed.

9 Claims, 1 Drawing Sheet

POLYESTER FIBERS HAVING HIGH STRENGTH AND HIGH MODULUS AND PROCESS FOR PRODUCING THE SAME

FIELD OF THE INVENTION

The present invention relates to ethylene terephthalate polyester fibers having both a high strength and a high modulus which have not been obtained heretofore in the prior art, and a process for producing the same.

More particularly, it relates to novel polyester fibers having both a high strength and a high modulus which can be furnished at a more practical price by means of spinning, swelling treatment if necessary and multi-stage stretching of a high molecular weight ethylene terephthalate polyester. The polyester fibers of the present invention are useful for tire cords which can be used in a field where conventional polyester tire cords have not been utilized, for example, as a belt material instead of steel in radial tires, or for a reinforcing material of thermoplastic composites and the like. The present invention also relates to a process for producing the novel polyester fibers.

BACKGROUND OF THE INVENTION

Usually, ethylene terephthalate polyester fibers are obtained industrially by melt-spinning a polyethylene terephthalate having an intrinsic viscosity (hereinafter abbreviated as IV) of less than 1.2 at a temperature of not lower than its melting point, and then hot-stretching and heat-treating the resulting filaments.

Properties of ethylene terephthalate polyester fibers obtained by such a conventional process are such that the initial tensile modulus is about 160 g/d and the strength is about 9 g/d, even in the case of high tenacity fibers. IV of fibers is at highest about 1.0 (Seni Soran, Nippon Seni Kikai Gakkai ed., 1970).

On the other hand, for ethylene terephthalate polyester fibers to be used for industrial materials such as tire cords, ropes and the like, it is requested to impart improved properties such as a high modulus, a high tenacity, high fatigue resistance, high wear resistance and the like.

As one of studies for imparting such improved properties to ethylene terephthalate polyester fibers, Shimizu et al. disclose that fibers having a high melting point can be obtained by a melt spinning method wherein spinning is carried out at a high speed such as at the takeup speed of 6,000 to 7,000 m/min. to obtain fibers having the melting point of 268.4° C. which is much higher than a melting point of conventional fibers [Seni Gakkaishi Vol. 33, No. 5, p 208 (1977): Vol. 34, NO. 2, p 43 (1978)]. However, the tensile modulus of the fibers is still low such as 80 g/d.

Then, as an important technique for imparting improved properties to polyester fibers, it is expected to develop a production technique using a high molecular weight ethylene terephthalate polyester wherein the polyester is highly stretched. Although it has been difficult to obtain a high molecular weight polyethylene terephthalate because a conventional polymerization of a polyethylene terephthalate is polycondensation and IV of a product is at highest about 1.8, it is possible to obtain an ultra-high-molecular-weight polyethylene terephthalate having IV of over 3.0 due to recent progress in a polymerization technique. Thus, there is a high possibility for imparting improved properties to polyethylene terephthalate polyester fibers.

However, when a melt spinning method is employed to impart improved properties to an ultra-high-molecular-weight polyethylene terephthalate, it is very difficult to spin the polymer by a conventional melt spinning technique because a melt viscosity is very high due to the ultra-high-molecular-weight of the polymer and fluidity of a melt thereof is very low. For that reason, a spinning device which can withstand high pressure has been proposed and spinning under high pressure and high shear conditions has been studied (Japanese Patent Kokoku No. 48-19887, Japanese Patent Kokoku No. 47-33727 and U.S. Pat. No. 3,846,377). However, ethylene terephthalate polyester fibers having desired improved properties have not yet been obtained.

On the other hand, Seizo et al. disclose a study for possibility of improvement of properties by increasing a molecular weight of stretched fibers obtained from a common polyethylene terephthalate having IV of less than 1.2 by solid phase polymerization [Seni Gakkaishi, Vol. 35, No. 8, p 328 (1979)]. As the result, stretched polyethylene terephthalate fibers having a high melting point such as 276° C. is obtained. However, the initial tensile modulus of the fibers is remarkably lowered from 50 g/d to 20 g/d. Therefore, although a melting point of the fibers becomes higher according to this method, the fibers having a high modulus in addition to the high melting point is not yet obtained.

In general, the properties required for fibers for industrial materials such as tire cords which reinforce rubber have desirably a high tenacity and a high modulus. However, polyethylene terephthalate fibers which are presently used for tire cords have the tensile strength of 9 g/d and the tensile modulus of 130 to 150 g/d. In general, polyethylene terephthalate fibers having a tensile modulus of less than 130 g/d are not used because they have less reinforcing effect on rubber.

Since the tensile strength of a polyethylene terephthalate fibers for tire cords is about 1 g/d lower than that of nylon 6 or nylon 66 fibers for tire cords and it has been requested to improve the strength thereof.

OBJECTS OF THE INVENTION

Under these circumstances, the present inventors have studied intensively to impart improved properties to ethylene terephthalate polyester fibers. As the result, it has been found that ethylene terephthalate polyester fibers having both a high strength and a high modulus which have not been obtained by a conventional technique can be obtained.

One object of the present invention is to provide ethylene terephthalate polyester fibers having both a high strength and a high modulus which are derived from their novel fibrous structure clearly distinguished from that of conventional ethylene terephthalate polyester fibers.

Another object of the present invention is to provide a process for producing the above ethylene terephthalate polyester fibers.

These objects as well as other objects and advantages of the present invention will become apparent to those skilled in the art from the following description with reference to the accompanying drawing.

Figure 1:
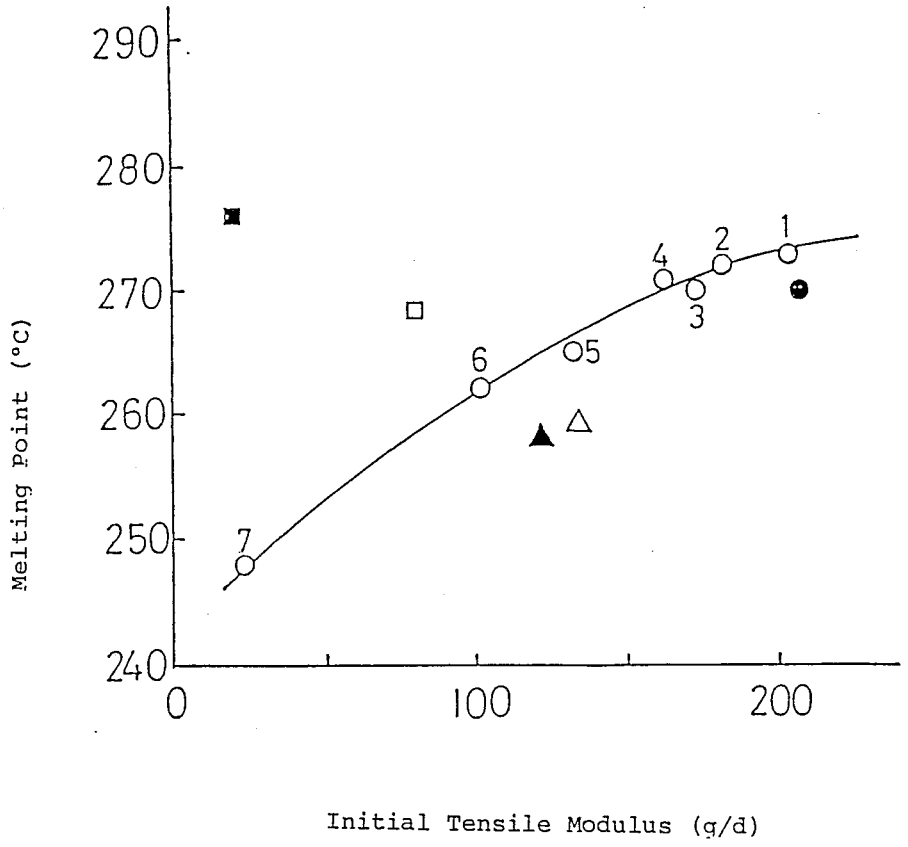
FIG. 1 is a graph illustrating relationship between the tensile modulus and the melting point of fibers of the present invention and those of Comparative Examples. In the graph, each symbol represents as follows.

○ : Fibers of Sample Nos. 1 to 7 obtained in Example 4.

• : Fibers of the present invention obtained in Example 5

Δ: Fibers obtained in Comparative Example 1.

▲ : Fibers obtained in Comparative Example 4.

□: Fibers disclosed in the literature by Shimizu et al.

■ : Fibers disclosed in the literature by Seizo et al.

SUMMARY OF THE INVENTION

According to the present invention, there is provided polyester fibers having both a high strength and a high modulus prepared from ethylene terephthalate polyester, and having an intrinsic viscosity of not less than 1.0 and an initial tensile modulus is not less than 130 g/d, said intrinsic viscosity being determined in a mixed solvent of p-chlorophenol and tetrachloro ethane (3 : 1) at 30° C.

The present invention also provides a process for producing polyester fibers having both a high strength and a high modulus which comprises melt-spinning ethylene terephthalate polyester, cooling and solidifying the filaments thus spun, taking off the filaments, followed by or after reeling up, subjecting the filaments to swelling treatment with an organic solvent having a solubility parameter of 7.5 to 15.0, and followed by or after treating the filaments so that they do not contain any substantial amount of the above organic solvent, stretching the filaments.

The present invention further provides a process for producing polyester fibers having both a high strength and a high modulus which comprises vacuum drying ethylene terephthalate polyester having an intrinsic viscosity of not less than 1.2, melting the polyester at a temperature of not lower than the melting point thereof, extruding the polyester from a nozzle orifice at a shear rate ($\dot{\gamma}$) of not higher than $1\times10^3$ sec$^{-1}$, cooling and solidifying the extruded filaments, taking off the filaments so that the double refractive index of taken off filaments is 0.002 to 0.060, followed by or after reeling up, stretching the filaments at least at a draw ratio calculated by the formula (1):

$$\text{Draw ratio} = \frac{100 + NE}{100} \quad (1)$$

wherein NE is a natural draw ratio (%) of unstretched filaments, at a temperature of not higher than 90° C. and then further stretching the filaments at a stretching stress of not lower than 5 g/d at a temperature ranging 150 to 250° C.

In the present invention, the desired result is obtained by spinning a high molecular weight ethylene terephthalate polyester having IV of not lower than 1.2 and stretching the high molecular chains which construct the fibers of the present invention toward the fiber axis direction as much as possible, that is, at a highest possible total draw ratio of the fibers.

DETAILED DESCRIPTION OF THE INVENTION

The high molecular weight ethylene terephthalate polyester used in the present invention is a polyester composed of a dibasic acid component, mainly terephthalic acid, and ethylene glycol, particularly, polyethylene terephthalate. Further, it is possible to use polyethylene terephthalate copolymerized with not more than 10 mole %, preferably, not more than 5 mole% of a known third component. Examples of a main third component include isophthalic acid, sulfoisophthalic acid, adipic acid, neopentyl glycol, pentaerythritol, glycerin, polyethylene glycol, polyethylene glycol alkyl ether and the like. Optionally, other known components can be also used.

The high molecular weight ethylene terephthalate polyester used in the present invention has IV of not lower than 1.2. Because, when fibers are produced according to the process of the present invention by using ethylene terephthalate polyester having IV of less than 1.2, the initial tensile modulus of the resulting fibers is not sufficiently high as that expected in the present invention in comparison with fibers obtained by a conventional process. Further, it is preferred to use polyester having IV of not less than 1.8. That is, the high molecular weight polyethylene terephthalate starting polymer of the present invention used in Examples 1 and 2 hereinafter has such properties that it shows a surprisingly high IV as described in Examples which has been not obtained in a conventional polyester and the melting point thereof is also very high (the melting point of the polymer having IV of 2.18 is 276.5° C.) and that the density thereof is very high as not less than 1.4 g/cm$^3$ (the density of the polymer having IV of 2.18 is 1.436 g/cm$^3$). Further, the solubility thereof is very good and the insoluble matter thereof is 0% by weight.

By the way, the above density was determined according to JIS-L-1013 (1981), 7.14.2 Density (Density gradient tube method) at a temperature of 30 ±0.1° C. by using carbon tetrachloride as the light medium and n-heptane as the heavy medium.

The above insoluble matter was determined by dissolving a polymer obtained (6 g) in a mixed solvent of trifluoroacetic acid and dichloroethane (1 : 1) (100 ml) with stirring at 150 to 200 r.p.m. at a temperature of 25° C. for 6 hours, filtering insoluble matter through a glass filter 20 to 30 μ) under reduced pressure, washing with chloroform, vacuum drying at 130° C. for 24 hours and then weighing, and expressed as % by weight based on 6 g of the original polymer.

According to the present invention, it is possible to stretch filaments at a high draw ratio due to decrease in entanglement between molecules, which is resulted from the combination of (1) choice of a polyester starting material having a high molecular weight which has not been hitherto used, (2) to make a shear rate at a nozzle orifice in a melt spinning step lower than that in a conventional technique, (3) optional swelling treatment of an unstretched material before stretching, and (4) subsequent multi-stage stretching at a high draw ratio. Thus, in the process of the present invention, it is possible to effect ultimate orientation stretching. This is one of the most characteristic points of the present invention.

Hereinafter, the process for producing the novel ethylene terephthalte polyester fibers of the present invention and characteristics of the fibers are further illustrated in detail.

In the present invention, after vacuum drying, the above starting polyester having IV of not less than 1.2 is melt-extruded at a temperature of not lower than its melting point, preferably, at least 20° C. higher than its melting point.

When vacuum drying is not effected, hydrolysis of the stretching polyester is taken place and IV thereof is remarkably decreased. Therefore, desired polyester fibers having a high tenacity and a high modulus are hardly obtainable and it is undesirable.

The melt extrusion is not limited to a specific method and there can be used an extruder type extruding machine, a piston type extruder, a twin screw kneader extruder and the like. It is necessary to extrude the polyester through a nozzle orifice at a shear rate ($\dot{\gamma}$) of not more than $1\times10^3$ sec$^{-1}$. The shear rate is calculated from the following formula:

$$\dot{\gamma} = \frac{32Q}{\pi D^3} \times \frac{1}{\rho} \quad (2)$$

wherein Q is an output through a single orifice (g/sec); D is a diameter of a nozzle orifice (cm): $\rho$ is a specific gravity of the polyester: and $\dot{\gamma}$ is a shear rate (sec$^{-1}$).

When $\dot{\gamma}$ is over $1\times10^3$ sec$^{-1}$, melt fracture or its premonition is taken place even at a temperature of not lower than 330° C. and it is difficult to impart improved properties. Accordingly $\dot{\gamma}$ should be not more than $1\times10^3$ sec$^{-1}$, preferably, not more than $3\times10^2$ sec$^{-1}$. The lower limit of the shear rate is not limited to a specific one and, when the shear rate is lower, extrusion of the polymer having the high viscosity becomes more stable. However, when the shear rate is not more than 1 sec$^{-1}$, productivity is impaired and it is undesirable.

The polyester filaments thus extruded are cooled and solidified and, after picking up an oiling agent, the filaments are taken off so that their double refractive index $\Delta n$ is not more than 0.060, preferably, 0.002 to 0.060. When $\Delta n$ is more than 0.060, improvement of stretching properties in the subsequent selling treatment is limited, which results in difficulty in imparting improved properties. On the other hand, when An is less than 0.002, spinning conditions become unstable and it is difficult to prevent formation of lengthwise spots of fibers.

Subsequently or after reeling up, the filaments thus taken off are dipped in a solution containing an organic solvent which can swell the polyester to effect swelling treatment. The solution for the swelling treatment is not limited so far as it can swell filaments without dissolution thereof to make stretching at a high draw ratio possible.

The organic solvent used in the solution for the swelling treatment of the present invention is that having the solubility parameter between 7.5 and 15.0 and being able to lower the glass transition temperature of amorphous ethylene terephthalate polyester unstretched filaments. The solubility parameter of polyethylene terephthalate is 10.7 and an organic solvent which can swell polyethylene terephthalate has two maximum peaks of the swelling effect at the solubility parameters of about 9.7 and about 12.0. Therefore, the solubility parameter of the organic solvent is preferably between 9.5 and 12.5. Typical examples of the organic solvent include chlorobenzene (9.5), nitrobenzene (10.0), dichloromethane (9.7), nitromethane (12.30), acetone (10.0), dioxane (10.05), benzyl alcohol (11.97), dimethyl formamide (12.1) and the like (the number in parentheses is the solubility parameter). However, the organic solvent is not limited thereto.

When the solubility parameter of the organic solvent is less than 7.5, or more than 15.0, the swelling effect is impaired and a desired improvement of stretching properties can not be expected. Thus, it is undesirable.

The solubility parameter used herein means a characteristic value of a liquid which is a measure of compatibility between liquids. The solubility parameter is brought forward by J. H. Hildebrand and represented by the symbol of "δ". The solubility parameter is calculated by the following formula:

$$\delta = (E/V)^{\frac{1}{2}} \quad (3)$$

wherein E is a molecular cohesive energy of the liquid; and V is a molecular volume. The solubility parameter is a constant of a substance, which depends upon only a temperature.

Further, the organic solvent used in the present invention is that can swell the unstretched filaments at a temperature of lower than the glass transition temperature of ethylene terephthalate polyester and, as the result, can lower the glass transition temperature thereof. More preferably, the organic solvent lowers the glass transition temperature of the unstretched filaments even if the solvent is removed from the filaments after dipping the unstretched filaments therein. Furthermore, when removal of the solvent is difficult, it adversely effects on the properties of stretched filaments. Therefore, it is preferred that the solvent is readily removable.

In view of the above, acetone is the most preferred organic solvent used in the swelling treatment of the present invention. Accordingly, the description hereinafter illustrates the swelling treatment using acetone as the organic solvent.

A liquid bath for dipping unstretched filaments is preferably acetone alone or an aqueous acetone solution containing not less than 40% by volume of acetone.

The temperature of the bath is preferably not higher than boiling point of the acetone solution and not higher than the glass transition temperature of the unstretched ethylene terephthalate polyester filaments.

The treatment time is not longer than 60 minutes, preferably, not longer than 15 minutes and the treatment can be carried out with or without stretching.

A method for dipping in the acetone solution is not limited to a specific one and there can be employed various conventional methods for dipping. For example, the dipping can be carried out continuously by providing a dipping bath between a delivery roll and a take off roll, and running unstretched filaments through the dipping bath so that the unstretched filaments are retained in the bath for a predetermined time, or can be carried out batch-wise by dipping unstretched filaments reeled up by a drum after spinning in a dipping bath. Particularly, a continuous dipping is preferred.

When a concentration of acetone is less than 40% by volume, it is very difficult to improve the modulus of stretched filaments, even if the dipping is carried out at 20° C. for 15 minutes.

Properties of polyethylene terephthalate unstretched filaments after the swelling treatment are illustrated by the following embodiment.

Unstretched filaments of polyethylene terephthalate (IV: 0.9, density: 1.344 g/cm$^3$, double refractive index: $7.4\times10^{-3}$, 51 d monofilament) were dipped in acetone, washed with water and air-dried. The glass transition temperature of the resulting unstretched filaments was measured by DSC and the crystallinity thereof was observed by wide angle X-ray diffraction. The results showed that the glass transition temperature of unstretched filaments before the dipping treatment was 72° C. and the filaments were amorphous. When the swelling treatment was carried out in 100% acetone at 20° C. for 1 minute, no glass transition temperature was not observed within the range of not lower than 0° C. and crystallization somewhat proceeded. When the dipping was carried out in an aqueous acetone solution containing 65% by volume of acetone at 20° C. for 5 minutes, the glass transition temperature was lowered to 14° C. and crystallization was scarcely accelerated. However, enhancement of molecular motion was observed due to decrease in X-ray diffraction intensity. Further, after allowing to stand at room temperature for 48 hours, the glass transition temperature was raised to 57° C. but was lower than that of untreated filaments.

Unstretched filaments treated by dipping in acetone could be readily stretched at a draw ratio of 4 times or more at about the glass transition temperature thereof, and the neck angle at the neck part in stretching was decreased to 17°, whereas the neck angle of untreated filaments was 34°. As decrease in the neck angle, the neck stress in stretching is also lowered and stretching can be efficiently carried out by applying a lower stress.

In another preferred embodiment, the swelling treatment is carried out in acetone alone or a mixture of acetone and water containing up to 50% by volume of water.

It is preferred to effect this treatment at a constant temperature of not higher than 50° C., preferably, not higher than 30° C., and to choose a treatment time so as to prevent whitening of the appearance and progress of crystallization of the filaments. Although the lower limit of the treatment temperature is not limited, it is preferred that the treatment temperature is at lowest 0° C. so as to keep fluidity of the solution for the swelling treatment. The treatment rate can be controlled by adjusting the treatment temperature and a concentration of a swelling agent in the swelling solution.

After the swelling treatment, it is preferred to replace acetone with water, benzene, alcohol and the like to cease progress of crystallization. By this replacement, change of stretching properties with time in the swelling treatment system can be inhibited. A method for replacing acetone is not limited to a specific one and there can be used a conventional dipping technique as described above with respect to the treatment with acetone dipping.

By the swelling treatment, stretching properties of the unstretched polyester filaments are remarkably increased. For example, in the case of polyethylene terephthalate fibers having the double refractive index of 0.004, stretching properties of the filaments are increased twice or more by treatment with aqueous acetone solution containing 95% by volume of acetone at 30° C. for 1 minute, followed by treatment with benzene at 30° C. for 1 minutes. That is, a drawing ratio at which stretching can be stably carried out at room temperature is increased from 3.2 times to 7.5 times.

Unstretched filaments treated by the swelling treatment is subsequently, or after replacing acetone as described above, stretched at a draw ratio of more than the natural draw ratio thereof at a temperature of not higher than the glass transition temperature. The term "natural draw ratio" used herein is a draw ratio necessary for disappearance of the neck part by stretching.

For hot stretching in the next step, preferably, the filaments do not contain acetone. Therefore, when the filaments treated by dipping in acetone are subsequently stretched at a temperature of not higher than the glass transition temperature, preferably, acetone in the filaments is replaced before hot stretching.

The polyester filaments subjected to swelling treatment are stretched at a highest possible draw ratio at a temperature of not higher than 90° C. In order to obtain a high strength, it is preferable to adjust Δn level of takeoff of the polyester and swelling conditions so that the draw ratio at a temperature of not higher than 90° C. is at least 7 times. Particularly, Δn of the polyester filaments taken off is 0.002 to 0.015. When the orientation temperature is higher than 90° C., stretching properties are impaired due to crystallization before completion of stretching. The lower limit of the orientation temperature after swelling is not limited but, preferably, it is at lowest 0° C. because it is necessary to maintain fluidity of the swelling solution.

After stretching at the relatively lower temperature, stretching is further effected at a temperature ranging 150° to 250° C. by applying a maximum stretching stress of not less than 5 g/d. The present inventors presume that application of a maximum stretching stress of not less than 5 g/d is effective for decrease in folded molecular chains, which results in remarkable increase in tie molecules which connect crystals.

The upper limit of the stretching stress is not limited. However, it is considered that a stretching stress of not less than 15 g/d is required to obtain a product having a breaking strength of about 30 g/d which is considered to be a maximum strength obtained by the present invention.

For stretching at the relatively higher temperature, multi-stage stretching is preferred. For example, it is preferred to carry out two stage stretching by firstly subjecting the filaments to a 1st stretching at a temperature ranging 150° to 200° C. by applying stretching stress of not more than 3 g/d and then a 2nd stretching by applying stretching stress of not less than 5 g/d. The lower limit of the stretching stress in the 1st stretching is not limited but the stretching stress of not more than 0.05 g/d is undesirable because no substantial natural extension is expected. Preferably, the filaments are further stretched at a temperature ranging 200° to 250° C. by applying stretching stress of 5 g/d.

The molecular chains of the filaments thus stretched as much as possible are preferably subjected to a treatment for relaxation within 10% at a temperature of not higher than 200° C. By this treatment, orientation of the molecular chains are aligned toward the fiber axis direction in order, and this is particularly useful for imparting a high modulus. When the relaxation treatment is not effected, free constriction is caused to somewhat impair properties.

Alternatively, the present invention can be also carried out by employing the following stretching step without effecting swelling treatment of unstretched filaments with the organic solvent.

That is, as described above, stretching of the resulting unstretched polyester filaments is effected at a draw ratio of not less than (100+NE)/100 times at a temperature of not higher than 90° C., wherein NE is a natural draw ratio of the unstretched filaments. Particularly, Δn of the polyester filaments taken off is preferably 0.002 to 0.015. When the orientation temperature is higher than 90° C., stretching properties are impaired due to crystallization before completion of stretching.

After the stretching at the relatively lower temperature, the filaments are further stretched at a temperature ranging 150° to 250° C. by applying a maximum stretching stress of not less than 5 g/d. The present inventors presume that application of a maximum stretching stress of not less than 5 g/d is effective for decrease in folded molecular chains, which results in remarkable increase in tie molecules which connect crystals.

The upper limit of the stretching stress is not limited. However, it is considered that a stretching stress of not less than 15 g/d is required to obtain a product having a breaking strength of about 30 g/d which is considered to be a maximum strength obtained by the present invention.

For stretching at the relatively higher temperature, multi-stage stretching is preferred. For example, it is preferred to carry out two stage stretching by firstly subjecting the filaments to a 1st stretching at a temperature ranging 150° to 200° C. by applying a stretching stress of not more than 3 g/d and then a 2nd stretching by applying a stretching stress of not less than 5 g/d. The lower limit of the stretching stress in the 1st stretching is not limited but the stretching stress of not more than 0.05 g/d is undesirable because no substantial natural extension is expected. Preferably, the filaments are further at a temperature ranging 200 to 250° C. by applying a stretching stress of 5 g/d.

The molecular chains of the filaments thus stretched as much as possible are preferably subjected to a treatment for relaxation within 10% at a temperature of not higher than 200° C. By this treatment, orientation of the molecular chains are aligned toward the fiber axis direction in order, and this is particularly useful for imparting a high modulus. The lower limit of the temperature for the relaxation is not limited but, preferably, it is no lower than 80° C. because control of stress relaxation becomes difficult at a lower temperature. When the relaxation treatment is not effected, free constriction is caused to somewhat impair properties.

The polyester fibers of the present invention thus obtained have IV of fibers of not less than 1.0 and a breaking stress of not less than 11.0 g/d, and show a very high modulus such as an initial tensile modulus of 160 g/d. That is, the polyester fibers of the present invention have both a high strength and a high modulus which have not been obtained heretofore in conventional polyester fibers.

On the other hand, according to the present invention, there can be obtained novel polyethylene terephthalate fibers having both a high strength and a high modulus as well as a melting point of not lower than 265° C., preferably, not lower than 269° C. by employing the following process.

That is, the above-described high molecular weight ethylene terephthalate polyester starting polymer, preferably, that having IV of not less than 1.2 is dissolved with stirring in a mixed solvent of trifluoroacetic acid and methylene chloride (1 : 1) at 30° C. under nitrogen atmosphere to prepare a spinning solution. Although the concentration of the polymer in the solution varies depending upon the molecular weight thereof, it should be suitable for formation of unstretched filaments which can be stretched at a draw ratio of at least 5 times. Preferably, the concentration is 5 to 40% by weight, more preferably, 10 to 35% by weight.

Then, the spinning solution is spun from a spinneret. The filaments are passed through a liquid bath mainly composed of water and then reeled up by a bobbin. The spinneret part may be a wet type wherein it is directly soaked in the liquid bath or it may be a dry-wet type wherein air layer of 500 to 2 mm in thickness is present between the spinneret part and the liquid bath. The liquid bath may be water alone or a liquid mainly composed of water such as an aqueous solution containing up to 10% by volume of an alcohol (e.g., methyl alcohol, ethyl alcohol, etc.), acetone, an ether or the like.

The filaments reeled up by a bobbin are washed in running water and, if necessary, after further washing with methyl alcohol, subjected to stretching as unstretched filaments.

Stretching can be carried out according to a conventional stretching technique such as contact or non-contact hot plate stretching, stretching under a hot atmosphere, hot roller stretching and the like. There can be also employed single-stage or multi-stage stretching using a stretching device having a temperature gradient. In order to obtain the desired fibers of the present invention, the orientation temperature is within the range of 40° to 250° C. and the draw ratio is 5 times or more, preferably, 7 times or more.

The relation between the initial tensile modulus and the melting point of ethylene terephthalate polyester fibers obtained in the Examples and Comparative Examples hereinafter and those obtained by Shimizu et al. and Seizo et al. is shown in the accompanying FIG. 1. As is seen from Example 4 (Sample Nos. 1 to 7) in FIG. 1, the melting point is raised as increase in the initial tensile modulus.

By the way, although it is desirable that the breaking strength and the initial tensile modulus of the polyester fibers having both a high strength and a high modulus are as high as possible, it is estimated from a possible production technique that the highest breaking strength is 30 g/d and the highest initial tensile modulus is 500 g/d.

As described above, the melting point of fibers obtained by the high speed spinning disclosed by Shimizu et al. is 268.4° C. However, the initial tensile modulus is very low such as 80 g/d. It is considered that this is resulted from such fiber structure that molecular arrangement of the amorphous layers are extremely disordered, while the highly oriented crystalline layers are developed very well.

On the other hand, the melting point of fibers obtain by the method disclosed by Seizo et al. is 276° C. which is higher than that of Shimizu et al. However, the initial tensile modulus is very low such as 20 g/d. It is considered that this is resulted from such fiber structure that the crystalline layers are increased as increase in folded molecular chains and tie molecules are decreased.

It is considered that the excellent properties such as a high tenacity and a high tensile modulus of the fibers of the present invention are resulted from such fiber structure that folded molecular chains is decreased as increase in a draw ratio and tie molecules which connect crystals are remarkably increased. This is suggested by the fact that narrow angle X-ray scattering intensity is weaker than that of commercially available polyester tire cord fibers.

It is considered that the main point for realization of the highly stretched molecular chain arrangement in the present invention is spinning of the high molecular weight polyester which have not been obtained in conventional polyesters, and decrease in entanglement between molecular chains by the swelling treatment to facilitate stretching at a high draw ratio.

The following Examples, Comparative Examples and Reference Examples further illustrate the present invention in detail but are not to be construed to limit the scope thereof.

Evaluation of the properties in the present invention are carried out as follows.

Measurement of intrinsic viscosity IV

In the present invention, the intrinsic viscosity IV of ethylene terephthalate polyester is determined by measuring the intrinsic viscosity [η] in a mixed solvent of p-chlorophenol and tetrachloroethane (3:1) at 30° C. and converted into that intrinsic viscosity IV in a mixed solvent of phenol and tetrachloroethane (60:40) by the following formula:

$$IV = 0.8325 \times [\eta] + 0.005 \quad (4)$$

Measurement of fineness

In a laboratory under normal conditions (temperature: 20 ±2° C., relative humidity: 65 ±2%), fineness of monofilament [denier (d)]is measured by using an autobiblo DENIER COMPUTER DC-11 B type fineness tester manufactured by Search Kabushiki Kaisha, Japan. The sample of a filament is 50 mm in length.

Measurement of strength of fibers

The tensile strength of monofilament is measured according to JIS-L-1013 (1981), 7.5.1 by using a constant speed stretching universal tensile machine Tensilon UTM-III manufactured by Toyo Borldwin Kabushiki Kaisha, Japan.

The measurement is carried out by using a 5 kgf tensile load cell and stretching under conditions of the sample length between the clamps of 10 cm, the elongation rate of 10 cm/min, (100% of the sample length between the clamps per 1 minute) and a chart speed of 100 cm/min. to determine a load (gf) at break of the sample. The tensile strength (gf/d) is calculated from the following formula and expressed as the strength (g/d):

$$\text{Tensile strength } (gf/d) = \frac{\text{strength at break } (gf)}{\text{fineness of sample } (d)} \quad (5)$$

Measurement of initial tensile modulus of fibers

The initial resistance to stretching (initial tensile modulus) of fibers is measured by the same manner as in the strength according to JIS-L-1013 (1981), 7.5.1 to prepare a load-elongation curve on a chart. Based on this curve, the initial resistance to stretching (gf/d) is calculated from the initial resistance to stretching calculation formula disclosed in JIS-L-1013 (1981), 7.10 and expressed as the initial tensile modulus (g/d).

Measurement of melting point

A high performance differential scanning calorimeter DSC-10A manufactured by Rigaku Denki Kabushiki Kaisha, Japan is used. The sample is cut into fine powder and 5 mg of the sample is accurately weighed into an aluminum sample pan.

The determination is carried out in a stream of argon gas under conditions of the temperature range of from room temperature to 300° C., the rate of temperature rise of 20° C./min., the determination range of 5 mcal/sec. and the chart speed of 20 mm/min. The melting peak temperature on the chart is read and expressed as the melting point of the sample.

Measurement of double refractive index (Δn)

Nikon polarization microscope POH model Litz Pereck compensator is used and a starter for a spectrum light source (Toshiba SLS-8-B) is used as the light source (Na light source). The sample having 5 to 6 mm in length and cut at the angle to the fiber axis of 45° is placed on a slide glass so that the cutting surface is faced to the upper side. The slide glass is placed on a rotary stage and the stage is adjusted by rotation so that the sample is located at the angle of 45° to the polarizer. The analyzer is inserted to obtain a dark field and then the compensator is adjusted to 30 to count the number of stripes (n). The compensator is rotated to the right-hand thread direction to read the scale of the compensator when the sample is firstly turned to dark (a), and then rotated to the left-hand thread direction to read the scale of the compensator when the sample is firstly turn to most dark (b) (in any case, the scale is read till 1/10). The compensator is returned to 30 and the analyzer is removed. The diameter of the sample (d) is determined and the double refractive index (Δn) is calculated from the following formula (average of 20 samples):

$$\Delta n = \Gamma/d \ (\lambda\text{: retardation, } = n\lambda o + \epsilon) \quad (6)$$

$\lambda o = 589.8$ mμ

ε: determined by C/10000 disclosed in the explanation of the Litz compensator and i $i = (a - b)$ (difference between the reads of the compensator).

EXAMPLE 1

Polyethylene terephthalate chips (IV: 0.6) obtained by using antimony trioxide as a catalyst (containing 0.05 mole % of antimony based on terephthalic acid) was heated with stirring in the heat transfer medium, triphenyl hydride, for 20 hours with blowing nitrogen gas, while maintaining the temperature at 237° C. to effect solid phase polymerization in the heat transfer medium to obtain polyethylene terephthalate starting polymer having IV of 2.18.

The starting polymer was vacuum dried at 120° C. for 16 hours and then melt extruded from a nozzle having 0.5 mm diameter of an extruder type miniature spinning machine under conditions of the spinning temperature of 310° C. and the output from a single orifice of 0.10 g/min. The filaments were cooled and solidified with a cold air at 0.3 m/sec. After picking up about 1% of an oiling agent, the filaments were reeled up at the spinning rate of 20 m/min. The resulting unstretched filaments have Δn of 0.004.

The unstretched filaments were dipped in an acetone solution containing 10% by volume of water at 30° C. for 10 minutes to subject to swelling treatment and then dipped in a benzene at 30° C. for 10 minutes.

Further, the filaments were stretched at the draw ratio of 7.5 times (elongation rate: 50 mm/min.) at room temperature and further stretched by two stage stretching at 185° C. by applying the stretching stresses of 1 g/d and 5 g/d, respectively (total three stage stretching). The filaments were subjected to 7% relaxation treatment at 130° C.

The resulting stretched filaments had the fineness of 8.1 d, the tensile strength of 14.5 g/d, the tensile modulus of 232 g/d (28.2 GPa), the melting point of 257° C. and IV of 1.10.

EXAMPLE 2

According to the same manner as described in Example 1, stretched filaments were obtained except that further stretching was effected at 210° C. by applying the stretching stress of 5 g/d after three stage stretching.

The resulting stretched filaments had the fineness of 9.0 d, the tensile strength of 14.2 g/d, the tensile modulus of 242 g/d (29.5 GPa), the melting point of 257.5° C. and IV of 1.11.

EXAMPLE 3

According to the same manner as described in Example 1, stretched filaments were obtained except that the relaxation treatment of 1 g/d was effected at 185° C. after three stage stretching.

The resulting stretched fibers had the fineness of 9.8 d, the tensile strength of 13.8 g/d, the tensile modulus of 230 g/d (28.1 GPa), the melting point of 256° C. and IV of 1.08.

COMPARATIVE EXAMPLE 1

Polyethylene terephthalate starting polymer for tire cords having IV of 1.10 and prepared by solid phase polymerization in a stream of nitrogen gas was melt-spun at 295° C. The resulting filaments were stretched at the total draw ratio of 6 times by two stage stretching at 80° C. and 240° C. Then, the filaments were subjected to a heat treatment at 240° C.

The resulting fibers had the fineness of 7.6 d, the tensile modulus of 135 g/d, the strength of 8.9 g/d, the melting point of 259.2° C. and IV of 0.95.

COMPARATIVE EXAMPLE 2

A sample of monofilament was collected from commercially available polyethylene terephthalate fibers (1000 d) and its properties were determined.

The sample had the fineness of 5.3 d, the tensile strength of 8.8 g/d, the tensile modulus of 141 g/d (17.4 GPa), the melting point of 255° C. and IV of 0.90.

COMPARATIVE EXAMPLE 3

According to the same manner as described in Example 1, stretched filaments were obtained except that the swelling treatment was not effected and 1st stage stretching at room temperature was effected at the draw ratio of 3.3 times.

The resulting filaments had the fineness of 7.6 d, the tensile strength of 12.4 g/d, the tensile modulus of 178 g/d (22.0 GPa) and IV of 1.07.

EXAMPLE 4

Polyethylene terephthalate chips (IV: 0.6) obtained by using antimony trioxide as a catalyst (containing 0.05 mole % of antimony based on terephthalic acid) was heated with stirring in the heat transfer medium, triphenyl hydride, for 20 hours with blowing nitrogen gas, while maintaining the temperature at 237° C. to effect solid phase polymerization in the heat transfer medium to obtain polyethylene terephthalate starting polymer having IV of 2.18.

The starting polymer was dissolved with stirring in a mixed solvent of trifluoroacetic acid and methylene chloride (1 : 1, v/v) at 30° C. under nitrogen atmosphere to obtain a polymer solution containing 16.9% by weight of the polymer. The polymer solution was used as a spinning solution and was spun from a spinneret having 0.2 mm diameter at room temperature into water at 23° C. The filaments spun were reeled up by a bobbin at 8 m/mi. The filaments reeled up by the bobbin were thoroughly washed in running water, air-dried and stretched.

Stretching was carried out at the temperature of 80° C. at the draw ratio of 4.0 times by using a non-contact hot plate. After this 1st stretching, stretching was further effected at various draw ratios as shown in Table 1 at the temperature of 160 to 240° C. The properties of the resulting stretched filaments are shown in Table 1 and the relationship between the tensile modulus and the melting point is shown in FIG. 1. As is seen from FIG. 1, the ethylene terephthalate polyester fibers of the present invention have a higher melting point and a higher modulus in comparison with conventional fibers.

TABLE 1

| Sample No. | Draw ratio (times) | Fineness (d) | Initial tensile modulus (g/d) | Strength (g/d) | Melting point (°C.) | IV |
|---|---|---|---|---|---|---|
| 1 | 10.6 | 14.7 | 204 | 11.9 | 272.7 | 1.69 |
| 2 | 8.1 | 18.6 | 181 | 10.2 | 272.0 | 1.69 |
| 3 | 7.5 | 20.1 | 173 | 9.7 | 270.0 | 1.70 |
| 4 | 6.1 | 24.3 | 163 | 6.5 | 271.0 | 1.70 |
| 5 | 4.8 | 33.1 | 133 | 4.1 | 265.0 | 1.80 |
| 6 | 4.1 | 38.5 | 102 | 3.5 | 262.0 | 1.85 |
| 7 | 0 | 158 | 24 | 0.5 | 248.0 | 1.88 |

EXAMPLE 5

Polyethylene terephthalate chips (IV: 0.6) obtained by using antimony trioxide as a catalyst (containing 0.025 mole % of antimony based on terephthalic acid) was subjected to solid phase polymerization at 237° C. for 12 hours according to the same manner as described in Example 1 to obtain polyethylene terephthalate starting polymer having IV of 3.42.

According to the same manner as described in Example 4, a spinning solution containing 13% by weight of the starting polymer having IV of 3.42 was prepared and spun. The filaments were reeled up at the rate of 4.5 m/min. by a bobbin. After washing and air-drying, the filaments were subjected to three stage stretching at 80° C., 165° C. and 210° C. at the total draw ratio of 10.3 times to obtain stretched filaments.

The stretched filaments had the fineness of 8.1 d, the tensile modulus of 208 g/d, the strength of 11.5 g/d, the melting point of 270.0° C. and IV of 2.53.

COMPARATIVE EXAMPLE 4

According to the same manner as described in Example 4, a spinning solution containing 18% by weight of the starting polymer used in Comparative Example 1 was prepared and spun. The filaments were reeled up at the rate of 8 m/min. by a bobbin. After washing and air-drying, the filaments were subjected to three stage stretching at 80° C., 165° C. and 210° C. at the total draw ratio of 5.8 times to obtain stretched filaments.

The stretched filaments had the fineness of 19.6 d, the tensile modulus of 122 g/d, the strength of 5.3 g/d, the melting point of 258.0° C. and IV of 0.94.

REFERENCE EXAMPLE 1

Unstretched polyethylene terephthalate filaments (51 d) which were obtained by melt spinning and had IV of 0.9, the density of 1.344 g/cm3 and the double refractive index of $7.4\times10^{-3}$ were dipped in an aqueous acetone solution containing 95% by volume of acetone at 20° C. for 5 minutes. After washing with benzene for 1 minutes, the filaments were immediately stretched at 20° C. and then further stretched at 210° C. by using a hot plate to obtain stretched filaments. The total draw ratio was 10.3 times. Further, the filaments were subjected to dry heat treatment with stretching at 240° C.

The properties of the resulting polyethylene terephthalate filaments are shown in Table 2.

REFERENCE EXAMPLE 2

According to the same manner as described in Reference Example 1, unstretched filaments were dipped in an aqueous acetone solution containing 65% by volume of acetone at 20° C. for 10 minutes. Then, the filaments were washed in running water for 30 minutes and air-dried at 20° C. for 1 hour.

After air-drying, the unstretched filaments were stretched at room temperature and then further stretched at 210° C. by using a hot plate to obtain stretched filaments. The total draw ratio was 9.4 times. Further, the filaments were subjected to dry heat treatment with stretching at 240° C.

The properties of the resulting polyethylene terephthalate filaments are shown in Table 2.

COMPARATIVE EXAMPLE 5

The same unstretched filaments as described in Reference Example 4 were stretched without dipping in an aqueous acetone solution. Stretching was effected a 80° C. and then 210° C. by using a hot plate. The total draw ratio was 5.3 times. Further, the filaments were subjected to dry heat treatment with stretching at 240° C.

The properties of the resulting polyethylene terephthalate filaments are shown in Table 2.

EXAMPLE 6

Unstretched polyethylene terephthalate filaments (66 d) which were obtained by melt spinning and had IV of 1.45, the density of 1.342 g/cm3 and the double refractive index of $6.0\times10^{-3}$ were dipped in an aqueous acetone solution containing 95% by volume of acetone at 20° C. for 5 minutes. After washing with benzene for 1 minutes, the filaments were immediately stretched at the draw ratio of 8.1 times at 20° C. Then, the filaments were further stretched at the draw ratio of 1.3 times at 160° C., and at the draw ratio of 1.2 times at 220° C. by using a hot plate to obtain stretched filaments. The total draw ratio was 12.6 times.

The properties of the resulting polyethylene terephthalate filaments are shown in Table 2.

COMPARATIVE EXAMPLE 6

The same unstretched filaments as described in Example 6 were stretched without dipping in an aqueous acetone solution. The stretching was effected at the draw ratio of 3.5 times at 80° C., at the draw ratio of 1.3 times at 160° C. and further at the draw ratio of 1.2 times at 220° C. The total draw ratio is 5.5 times.

The properties of the resulting polyethylene terephthalate filaments are shown in Table 2.

When the filaments of Comparative Examples 1 and 2 and Example 6 wherein the swelling treatment with acetone is effected are compared with those of Reference Examples 5 and 6 wherein no swelling treatment is effected, the total draw ratio of the former fibers is very high such as 9 times or more, and the modulus thereof is also remarkably improved. Further, the strength is also improved. Particularly, the effect of improvement becomes more remarkable as increase in the molecular weight.

EXAMPLE 7

The same unstretched filaments as described in Example 6 were dipped in an aqueous acetone solution containing 95% by volume of acetone at 20° C. for 5 minutes and then stretched at a draw ratio of 8.5 times at 20° C. Then, the filaments were washed with benzene for 1 minutes to replace acetone.

The filaments were stretched at the draw ratio of 1.3 times at 160° C. and further at the draw ratio of 1.2 times at 220° C. by using a hot plate. The total draw ratio was 13.3 times.

The properties of the resulting polyethylene terephthalate filaments are shown in Table 2.

TABLE 2

| | IV of unstretched filaments | Acetone treatment Acetone (% by vol.) | 1st stage stretching Temp. (°C.) | 1st stage stretching Draw ratio (times) | 2nd stage stretching Temp. (°C.) | 2nd stage stretching Draw ratio (times) | 3rd stage stretching Temp. (°C.) | 3rd stage stretching Draw ratio (times) | Total draw ratio (times) |
|---|---|---|---|---|---|---|---|---|---|
| Ref. Ex. 1 | 0.9 | 95 | 20 | 5.7 | 210 | 1.8 | — | — | 10.3 |
| Ref. Ex. 2 | 0.9 | 65 | 20 | 5.5 | 210 | 1.7 | — | — | 9.4 |
| Comp. Ex. 5 | 0.9 | — | 80 | 4.1 | 210 | 1.3 | — | — | 5.3 |
| Ex. 6 | 1.45 | 95 | 20 | 8.1 | 160 | 1.3 | 220 | 1.2 | 12.6 |
| Comp. Ex. 6 | 1.45 | — | 80 | 3.5 | 160 | 1.3 | 220 | 1.2 | 5.5 |
| Ex. 7 | 1.45 | 95 | 20 | 8.5 | 160 | 1.3 | 220 | 1.2 | 13.3 |

| | Properties after stretching Fineness (d) | Strength (g/d) | Modulus (g/d) | Properties after dry heat treatment Strength (g/d) | Modulus (g/d) |
|---|---|---|---|---|---|
| Ref. Ex. 1 | 5.0 | 11.8 | 181 | 11.5 | 186 |
| Ref. Ex. 2 | 5.5 | 10.9 | 172 | 10.6 | 179 |
| Comp. Ex. 5 | 9.6 | 9.2 | 117 | 9.0 | 124 |
| Ex. 6 | 5.2 | 14.2 | 237 | — | — |
| Comp. Ex. 6 | 12.1 | 10.6 | 135 | — | — |
| Ex. 7 | 5.0 | 13.9 | 220 | — | — |

EXAMPLE 8

Polyethylene terephthalate chips (IV: 0.6) obtained by using antimony trioxide as a catalyst (containing 0.05 mole % of antimony based on terephthalic acid) was heated with stirring in the heat transfer medium, triphenyl hydride, for 20 hours with blowing nitrogen gas, while maintaining the temperature at 237° C. to effect solid phase polymerization in the heat transfer medium to obtain polyethylene terephthalate starting polymer having IV of 2.18.

The starting polymer was vacuum dried at 120° C. for 6 hours and then melt extruded from a nozzle having 0.5 mm diameter of an extruder type miniature spinning machine under conditions of the spinning temperature of 310° C. and the output from a single orifice of 0.10 g/min. The filaments were cooled and solidified with a cold air at 0.3 m/sec. After picking up about 1% of an oiling agent, the filaments were reeled up at the spinning rate of 20 m/min. The resulting unstretched filaments have An of 0.004.

NE of the unstretched filaments was 220%.

The filaments were stretched at the draw ratio of 3.3 times (elongation rate: 50 mm/min.) at room temperature and further stretched by two stage stretching at 185° C. by applying stretching stresses of 1 g/d and 5 g/d, respectively (total three stage stretching). The filaments were subjected to 7% relaxation treatment at 130° C.

The resulting stretched filaments had the fineness of 7.6 d, the tensile strength of 12.4 g/d, the tensile modulus of 178 g/d (22.0 GPa), the melting point of 256° C. and IV of 1.07.

EXAMPLE 9

Unstretched filaments obtained according to the same manner as in Example 8 were stretched at the draw ratio of 3.3 times (elongation rate: 50 mm/min.) at room temperature and then further stretched by two stage stretching at 185° C. by applying stretching stresses of 1 g/d and 5 g/d, respectively (total three stage stretching). The filaments were further stretched at 210° C. by applying a stretching stress of 5 g/d.

The resulting stretched filaments had the fineness of 7.8 d, the tensile strength of 11.9 g/d, the tensile modulus of 162 g/d (20.0 GPa), the melting point of 255.5° C. and IV of 1.08.

COMPARATIVE EXAMPLE 7

Polyetylene terephthalate starting polymer having IV of 1.00 for tire cords were melt-extruded at 295° C. at the output from single orifice of 0.75 g/min. by using an extruder type miniature spinning machine having a nozzle of 0.5 mm diameter. The filaments were cooled and solidified with quench air at 0.3 m/sec. After picking up about 1% of an oiling agent, the filaments were reeled up at a spinning rate of 20 m/min. The resulting unstretched filaments have Δn of 0.004.

The unstretched filaments were stretched under conditions shown in Table 3.

The resulting stretched filaments had the fineness of 3.6 d, the tensile strength of 12.5 g/d, the tensile modulus of 145 g/d (17.9 GPa), the melting point of 255° C. and IV of 0.87.

TABLE 3

| | |
|---|---|
| Unstretched filaments 1st feed roll | |
| Temperature (°C.) | 20 |
| Speed (m/min.) | 30 |
| Prestretching (times) | 1.05 |
| Unstretched filaments 2nd feed roll | |
| Temperature (°C.) | 20 |
| Speed (m/min.) | 81.5 |

TABLE 3-continued

| | |
|---|---|
| High pressure steam | |
| Temperature (°C.) | 400 |
| Pressure (kg/cd) | 3.5 |
| 1st stretching roll | |
| Temperature (°C.) | 20 |
| Speed (m/min.) | 110 |
| Draw ratio (times) | 3.49 |
| Heater (slit heater) | |
| Temperature (°C.) | 245 |
| Length (mm) | 1000 |
| 2nd stretching roll | |
| Temperature (°C.) | 20 |
| Speed (m/min.) | 200 |
| Draw ratio (times) | 1.82 |
| Total draw ratio (times) | 6.67 |

According to the present invention, it is possible to impart both a high strength and a high modulus to ethylene terephthalate polyester fibers, which has not been obtained heretofore in the prior art. Particularly, it is possible to impart such higher properties to polyester fibers obtained by melt spinning technique. Further, according to the present invention, there can be provided polyester fibers having both a high strength and a high modulus resulted from the novel fibrous structure which can be clearly distinguished from that of conventional fibers.

The tensile strength and the tensile modulus of the fibers of the present invention are remarkably improved, while conventional high tenacity polyester fibers have the tensile strength of at highest about 9 g/d and the tensile modulus of 130 to 160 g/d (16 to 19 GPa). Therefore, when the fibers of the present invention are used as a reinforcing material of rubber such as tire cords, it is possible to rationalize construction of tire cords such as less ply-less end and the like.

Since the fibers of the present invention can be expected to have high wear resistance and high fatigue resistance due to their higher molecular weight in addition to the above properties, they are useful for all industrial materials which require elasticity and heat resistance and the like, for example, tire cords, belts, water proof clothes, hoses and the like.

Further, according to the present invention, there can be provided ethylene terephthalate polyester fibers a high melting point and a high modulus which have not been obtained heretofore in the prior art.

What is claimed is:

1. Polyester fibers having both a high strength and a high modulus prepared from ethylene terephthalate polyester, and having an intrinsic viscosity of not less than 1.0, a breaking strength of not less than 11 g/d and an initial tensile modulus of not less than 200 g/d, said intrinsic viscosity being determined in a mixed solvent of p-chlorophenol and tetrachloroethane at (3:1) 30° C.

2. Polyester fibers according to claim 1, wherein the fibers having an intrinsic viscosity of not less than 1.1.

3. Polyester fibers according to claim 2, wherein the fibers having an intrinsic viscosity of not less than 1.2.

4. Polyester fibers according to claim 1, wherein the fibers have a breaking strength of not less than 12 g/d.

5. Polyester fibers according to claim 4, wherein the fibers have a breaking strength of not less than 13 g/d.

6. Polyester fibers according to claim 1, wherein the fibers have an initial tensile modulus of not less than 240 g/d.

7. Polyester fibers according to claim 1, wherein the fibers having melting point of not less than 265° C.

8. Polyester fibers according to claim 7, wherein the fibers have a melting point of not less than 269° C.

9. Polyester fibers having both a high strength and a high modulus prepared from ethylene terephthalate polyester, and having an intrinsic viscosity of not less than 1.0, a breaking strength of not less than 11 g/d, an initial tensile modulus of not less than 130g/d and a melting point of not less than 269° C., said intrinsic viscosity being determined in a mixed solvent of p-chlorophenol and (3:1) at 30° C.

* * * * *